US012588756B1

(12) United States Patent
Cornell et al.

(10) Patent No.: US 12,588,756 B1
(45) Date of Patent: Mar. 31, 2026

(54) POWERED LIFT SYSTEM FOR CABINET SHELVES

(71) Applicants: Richard Cornell, Knoxville, TN (US); Benjamin D. Nibali, Alcoa, TN (US); Maia Judd, Alcoa, TN (US)

(72) Inventors: Richard Cornell, Knoxville, TN (US); Benjamin D. Nibali, Alcoa, TN (US); Maia Judd, Alcoa, TN (US)

(73) Assignee: Richard Cornell, Knoxville, TN (US)

( * ) Notice: Subject to any disclaimer, the term of this patent is extended or adjusted under 35 U.S.C. 154(b) by 0 days.

(21) Appl. No.: 19/031,110

(22) Filed: Jan. 17, 2025

(51) Int. Cl.
*A47B 51/00* (2006.01)
*A47B 46/00* (2006.01)

(52) U.S. Cl.
CPC ..... *A47B 51/00* (2013.01); *A47B 46/00* (2013.01)

(58) Field of Classification Search
CPC ..... A47B 46/00; A47B 49/00; A47B 49/008; A47B 51/00; A47B 63/062
USPC ..... 312/245, 246, 247, 266, 319.5
See application file for complete search history.

(56) References Cited

U.S. PATENT DOCUMENTS

| | | | | |
|---|---|---|---|---|
| 883,305 | A | 3/1908 | Fetch | |
| 2,555,254 | A | 5/1951 | Stebbins | |
| 2,822,229 | A | 2/1958 | Carlson | |
| 3,224,827 | A | 12/1965 | Foster et al. | |
| 3,857,623 | A | 12/1974 | Schneller | |
| 4,076,351 | A | 2/1978 | Wyant | |
| 5,228,763 | A | 7/1993 | Gingold | |
| 5,249,858 | A | 10/1993 | Nusser | |
| 5,308,158 | A | 5/1994 | Vogelgesang et al. | |
| 6,367,898 | B1 | 4/2002 | Jobe | |
| 8,414,093 | B2 * | 4/2013 | Moran | A47B 51/00 312/246 |
| 8,424,693 | B1 | 4/2013 | Hoover | |
| 8,424,983 | B1 | 4/2013 | Strauss et al. | |
| 8,579,390 | B2 * | 11/2013 | Bruestle | A47B 51/00 312/247 |
| 8,991,948 | B2 | 3/2015 | Marsters et al. | |
| 9,055,813 | B2 | 6/2015 | Telthörster et al. | |
| 10,034,540 | B1 | 7/2018 | Abbott et al. | |
| 10,561,235 | B1 * | 2/2020 | Abbott | A47B 77/10 |
| 10,602,842 | B2 | 3/2020 | Bryan et al. | |
| 11,478,078 | B1 * | 10/2022 | Cornell | B60B 33/0002 |

(Continued)

OTHER PUBLICATIONS

Granberg , "Lifting Systems for Wall Cabinets", URL: https://www.granberg.se/en/our-products/accessible-kitchen/lifting-systems-wall-cabinet, 2025, 1 Page.

(Continued)

*Primary Examiner* — James O Hansen
(74) *Attorney, Agent, or Firm* — Blanchard Horton PLLC

(57) ABSTRACT

A lift system for a cabinet including a guide path along at least one side wall of a cabinet, the guide path defining a horizontal segment and a non-horizontal segment. A drive member is disposed along the guide path, and a shelf unit is in engagement with the drive member. A drive mechanism is configured to drive the drive member along the guide path, thereby translating the shelf member along the guide path. Translation of the shelf member along the horizontal segment of the guide path moves the shelf member outside the cabinet, and translation of the shelf member along the non-horizontal segment of the guide path moves the shelf member in a vertical direction in relation to the cabinet.

11 Claims, 13 Drawing Sheets

(56) References Cited

U.S. PATENT DOCUMENTS

| | | | | |
|---|---|---|---|---|
| 11,723,457 | B2 * | 8/2023 | Gelber | B25H 3/00 312/247 |
| 11,771,221 | B1 | 10/2023 | Crolley | |
| 2016/0166058 | A1 | 6/2016 | Bunch | |
| 2022/0104615 | A1 | 4/2022 | Sharma | |
| 2022/0167740 | A1 * | 6/2022 | Sharma | A47B 51/00 |

OTHER PUBLICATIONS

Handyct, "Motorized pull down Lift cabinet shelf "Shlide" 120v for Kitchen cabinets, your size", URL: https://handyct.com/motorized-pull-down-lift-cabinet-shelf-shlide-120v-for-kitchen-cabinets-your-size/?srsitid=AfmBOoo3a7IMJTxCq4GVuBHBm22yXbY-JYbJJcjzSjiDo5yw9LzHTumq, 2025, 1 Page.

Kitchensource.com, "Dropout Cabinet Fixtures Patented Filler Spice Rack Storage System, Right or Left Facing", URL: https://www.kitchensource.com/spice-racks/dcf-8001.htm?srsltid=AfmBOorKucpF8S9tYsfull1-dhvtLON8gOGOxVV7dLHLz4Wxfj2hB11a, 2025, 1 Page.

Storage Motion, "Ceiling Cabinet with Shelf Lift—CeilingLift", URL: https://storagemotion.com/ceilinglift/, 2020, 1 page.

Storage Motion, "ShoeSelect®—Automated Shoe Storage", URL: https://storagemotion.com/shoeselect/, 2020, 1 Page.

Storage Motion, "The Automated WardrobeLift®", URL: https://storagemotion.com/wardrobelift/, 2020, 1 Page.

Wayfair, "Lauvella Pull Down Shelf Upper Kitchen Wall Cabinet Storage Organizer", URL: https://www.wayfair.com/kitchen-tabletop/pdp/rebrilliant-lauvella-pull-down-shelf-upper-kitchen-wall-cabinet-storage-organizer-w011336498.html, 2025, 1 Page.

Youtube, "Automatic Drop Down Shelf Start To Finish", URL: https://www.youtube.com/watch?v=N2QE2RpB8gE, Nov. 11, 2023, 1 Page.

* cited by examiner

POWERED LIFT SYSTEM FOR CABINET SHELVES

CROSS-REFERENCE TO RELATED APPLICATIONS

Not Applicable.

STATEMENT REGARDING FEDERALLY SPONSORED RESEARCH OR DEVELOPMENT

Not Applicable.

FIELD OF INVENTION

The present general inventive concept relates to movable cabinet shelves, and, more particularly, to a powered lift system that controls the positioning of cabinet shelves.

BACKGROUND

Cabinetry is one of the most important features of a home, and often commercial or industrial spaces, because of the unique combination of aesthetic and utilitarian features. Cabinets often provide a central decorative theme in residential kitchens and can provide a host of different storage options such as drawers, shelves, racks, and so on. However, wall mounted cabinets, which are found in almost every kitchen, can present challenges to users who have trouble reaching some of the shelves inside at all, much less the items that may be on a back area of the shelf. People of shorter heights may need to sometimes stand on items such as ladders, chairs, etc., to access those shelves, which provides ample opportunity for serious fall injuries to that person. Such a situation may be even more problematic for persons living with various disabilities that decrease their reach even further. Likewise, people of limited range of motion may have trouble reaching or accessing cabinet shelves near the floor, such as in cabinets mounted beneath countertops or at other lower positions. Therefore, it would be desirable to have movable shelves in the wall cabinets that could be brought forward and lowered or raised as needed so that users could more easily and conveniently retrieve items from the shelves, and/or store items on the shelves.

BRIEF SUMMARY

According to various example embodiments of the present general inventive concept, a powered lift system for cabinet shelves is provided that allows a user to bring a shelf, or set of shelves, from within a cabinet to a forward position outside the cabinet and to a different elevation with an easy manipulation of a system control interface. For example, a plurality of buttons could be arranged near the front of the cabinet that allow a user to bring the set of shelves along a predetermined path out of the cabinet and either upward or downward, as determined by the predetermined path. In various example embodiments, the powered lift system for cabinet shelves may be paired with a powered revolving shelf system that allows a user to also bring a desired shelf to a forward section of the set of shelves, and to a desired elevation, with an easy manipulation of a system control interface. For example, the plurality of buttons could be arranged to allow a user to also revolve all of the shelves about a point proximate the center of the cabinet space until the desired shelf is in the most accessible position.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by providing a cabinet having a lift system comprising at least one guide path extending along at least one side wall of the cabinet. The at least one guide path may define a horizontal segment and a non-horizontal segment. A drive member may be disposed along the at least one guide path, and a shelf unit may be in engagement with the drive member. A drive mechanism may be configured to drive the drive member along the at least one guide path, thereby translating the shelf member along the at least one guide path. In this arrangement, translation of the shelf member along the horizontal segment of the at least one guide path may move the shelf member between a first position inside the cabinet and a second position outside the cabinet, and translation of the shelf member along the non-horizontal segment of the at least one guide path may move the shelf member in a non-horizontal direction in relation to the cabinet.

Additional aspects and advantages of the present general inventive concept may be achieved by providing a cabinet in which the at least one guide path is defined by a drive track extending along the at least one side wall of the cabinet. In some embodiments, the drive track may define a first guide path and a second guide path, each guide path defining a horizontal segment and a non-horizontal segment. In some embodiments, the drive track may be a circuitous track. In some embodiments, the drive mechanism may comprise a flexible drive extending along the drive track. In some embodiments, the drive track may extend from a forward end of the horizontal segment of the first guide path, along the vertical segment of the first guide path, to a rearward end of the horizontal segment of the second guide path, along the vertical segment of the second guide path, and to a rearward end of the horizontal segment of the first guide path. In some embodiments, a plurality of followers may be provided, each follower secured to the shelf unit and fixed along a portion of the flexible drive along a corresponding guide path. In this arrangement, movement of the flexible drive along the drive track may translate each follower along the corresponding guide path. In some embodiments, the horizontal segment of each guide path may be of equal length and oriented in parallel, spaced apart relationship to the horizontal segment of each other guide path. In some embodiments, each follower may be mounted in a respective position offset from a rear of the shelf unit. In some embodiments, the drive track may be defined by a drive panel removably secured along the at least one side wall of the cabinet.

Additional aspects and advantages of the present general inventive concept may be achieved by providing a lift system comprising a drive panel securable along an inner side surface of a cabinet. The drive panel may define at least one guide path defining a horizontal segment and a non-horizontal segment. A drive member may be disposed along the at least one guide path. A plurality of followers may be provided in engagement with the drive member, each follower being securable to a cabinet shelf. A drive mechanism may be configured to drive the drive member along the at least one guide path, thereby translating the followers along the at least one guide path.

Additional aspects and advantages of the present general inventive concept may be achieved by providing a lift system in which the followers are positioned along the at least one guide path so that translation of one follower along the horizontal segment of the at least one guide path translates each of the followers parallel to the horizontal segment of the at least one guide path between a first position and a second position, and in which translation of one follower along the non-horizontal segment of the at least one guide path translates each of the followers parallel to the non-horizontal segment. In some embodiments, the at least one guide path may be defined by a drive track extending along the drive panel. In some embodiments, the drive track may define a first guide path and a second guide path, each guide path defining a horizontal segment and a non-horizontal segment. In some embodiments, the drive track may be a circuitous track. In some embodiments, the drive mechanism may comprise a flexible drive extending along the drive track. In some embodiments, the drive track may extend from a forward end of the horizontal segment of the first guide path, along the vertical segment of the first guide path, to a rearward end of the horizontal segment of the second guide path, along the vertical segment of the second guide path, and to a rearward end of the horizontal segment of the first guide path. In some embodiments, the horizontal segment of each guide path may be of equal length and oriented in parallel, spaced apart relationship to the horizontal segment of each other guide path. In some embodiments, the drive panel may further comprise a first drive panel securable along a first inner side surface of a cabinet and a second drive panel securable along a second inner side surface of the cabinet, each of the first and second drive panels defining a drive track, the drive track of the first drive panel being formed to mirror the drive track of the second drive panel. In some embodiments, the drive member may further comprise a first drive member received along the drive track of the first drive panel and a second drive member received along the drive track of the second drive panel, each of the followers being in engagement with one of the first or second drive members. In some embodiments, the drive mechanism may be configured to drive the first and second drive members in unison with one another.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Figure 1:
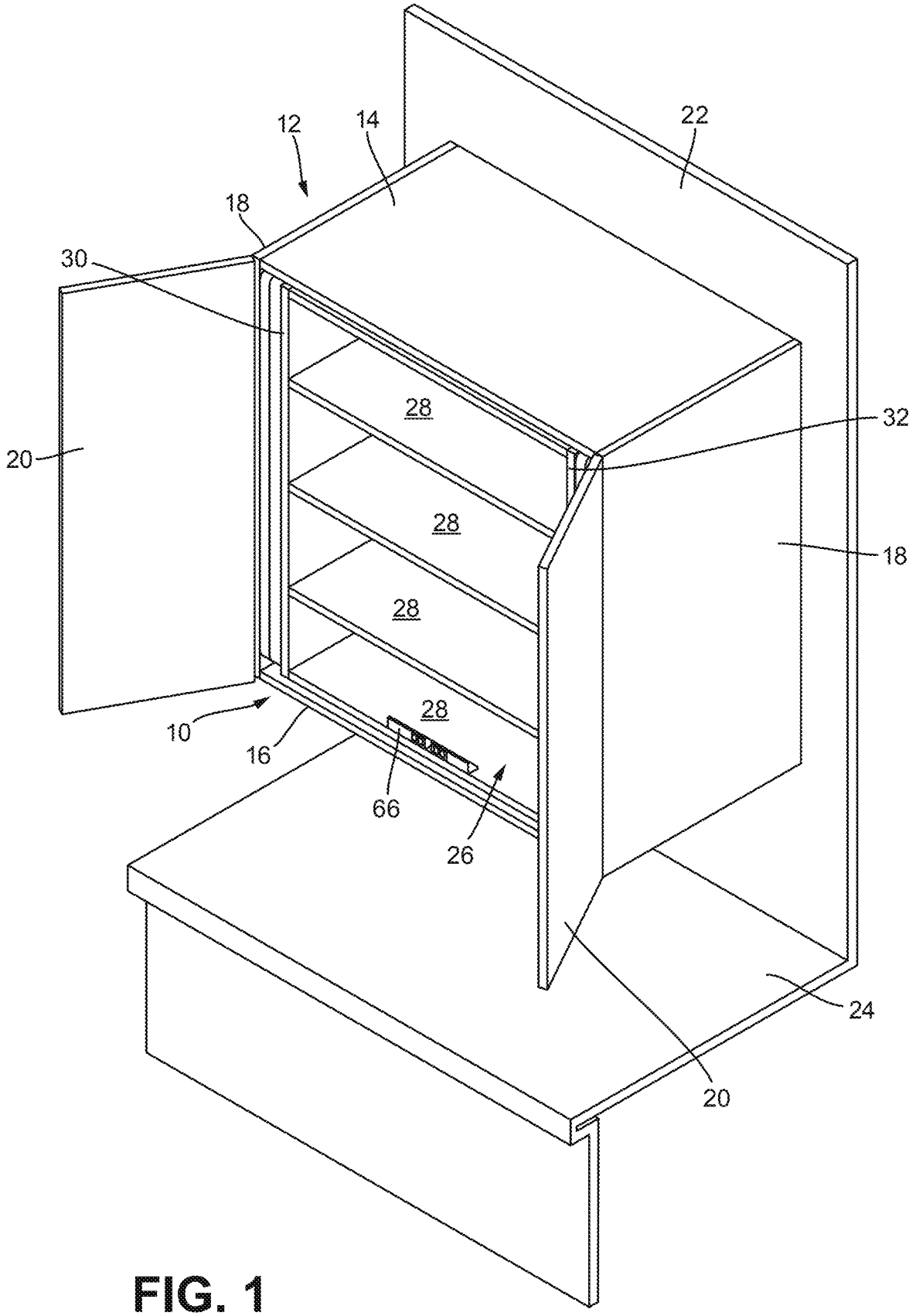
FIG. 1 illustrates a perspective view of a powered lift system for cabinet shelves installed in a cabinet according to one example embodiment of the present general inventive concept.

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" those other elements or features. Thus, the exemplary term "below" can encompass both an orientation of above and below. The device may be otherwise oriented (rotated 90 degrees or at other orientations) and the spatially relative descriptors used herein interpreted accordingly.

According to various example embodiments of the present general inventive concept, a powered lift system for cabinet shelves is provided that allows a user to bring a shelf, or set of shelves, from within a cabinet to a forward position outside the cabinet and to an altered elevation with an easy manipulation of a system control interface. For example, a plurality of buttons could be arranged near the front of the cabinet that allow a user to bring the set of shelves along a predetermined path out of the cabinet and either upward or downward, as determined by the predetermined path. The provided system for moving the shelves to a forward position and altered elevation from within a cabinet may be referred to herein as a "lift" system. Various example embodiments allow the shelves to be moved forward or backward into and out of a cabinet, and up or down in relation to the cabinet, along one or more tracks or other predetermined paths to allow a user to conveniently access one or more desired shelves. The shelves of these various example embodiments are secured along those tracks or paths so as not to rotate, rock, or otherwise deviate from the generally horizontal plane of the shelves, even during movement along the paths. While most of the example embodiments described herein are configured in wall mounted cabinets, such as those typically mounted above or below a kitchen counter, various example embodiments of the present general inventive concept may be provided in other types of storage units as well, such as for example bathroom or garage cabinets, pantries, wardrobes, armoires, etc.

FIG. 1 illustrates a perspective view of a powered lift system installed in a cabinet according to an example embodiment of the present general inventive concept. The powered lift system 10 of this example embodiment is shown installed in a cabinet 12 having a top panel 14, a bottom panel 16, two side panels 18, and two cabinet doors 20. The cabinet 12 is shown mounted to a wall 22 above a countertop 24. A shelf unit 26 comprising a plurality of shelves 28 is received within the cabinet 12 and comprises generally first and second opposite side walls 30, 32 with the shelves 28 rigidly secured in relation to, and extending between, the side walls 30, 32. When the shelf unit 26 is received within the cabinet 12, as shown in FIG. 1, each of the side walls 30, 32 is arranged in parallel-planar relationship within a corresponding one of the side panels 18.

The shelf unit 26 is arranged to move in relation to the cabinet 12 according to at least a portion of the shape of one or more guide tracks 34*a*, 34*b* defined between each side wall 30, 32 of the shelf unit 26 and corresponding side panels 18 of the cabinet 12. As will be described in more detail herein, the guide tracks, in association with a drive mechanism, provide linear translational movement to the shelf unit 26 that generally follows a path horizontally forward from within the cabinet 12, and then along a vertically-oriented direction, either downward or upward in relation to the cabinet 12.

Figure 2:
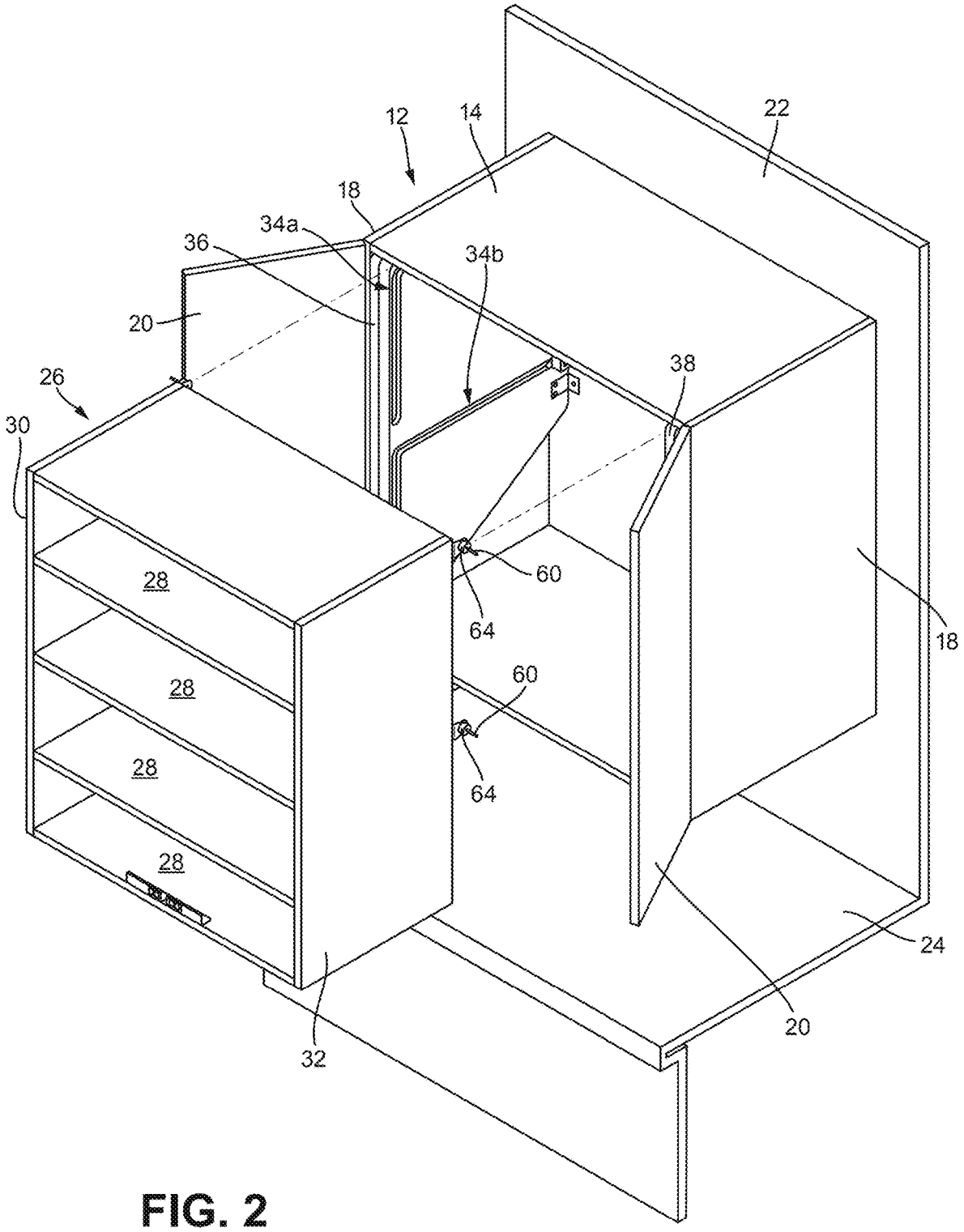
FIG. 2 illustrates a partially-exploded perspective view of the powered lift system and cabinet of FIG. 1.

With reference to FIG. 2, in the illustrated embodiment, the guide tracks 34*a*, 34*b* are defined by a pair of drive panel units 36, 38 mounted along respective side panels 18 of the cabinet 12 between the cabinet side panels 18 and the side walls 30, 32 of the shelf unit 26. More specifically, in the illustrated embodiment, each drive panel unit 36, 38 extends parallel-planar between and adjacent a corresponding associated side panel 18 of the cabinet 12 and a corresponding associated side wall 30, 32 of the shelf unit 26. Referring to FIGS. 2-5, each drive panel unit 36, 38 comprises an inner drive panel 40 and an outer drive panel 42 arranged in close conformity to, and in substantially overlying and parallel-planar relationship with, one another. A circuitous drive track 44 is formed between the inner and outer drive panels 40, 42 and is configured to receive and carry a circuitous flexible drive 46, such as for example a drive chain, drive belt, or the like, extending along the length of the drive track 44. The drive track 44 includes at least one, and preferably two or more, horizontal portions 48*a*, 48*b* extending in a front-to-back orientation along the inner and outer drive panels 40, 42, and two vertical portions 50*a*, 50*b*, with each vertical portion extending from a forward end of an associated horizontal portion 48*a*, 48*b* in a vertical direction.

For ease of reference, each horizontal portion 48*a*, 48*b* and associated vertical portion 50*a*, 50*b* may referred to herein as a "guide path" of the drive track 44. The overall path of the drive track 44 and associated flexible drive 46 extends along the interface between the inner and outer drive panels 40, 42 to connect the rearward end of each guide path horizontal portion 48*a*, 48*b* with a distal end of the vertical portion 50*a*, 50*b* of an adjacent guide path, the "distal" end being the end of the vertical portion 50*a*, 50*b* opposite the associated horizontal portion 48*a*, 48*b*. Stated differently, in the illustrated embodiment, the drive track 44 extends forwardly along the horizontal portion 48*a* of an upper one of the guide paths, thereafter vertically along the vertical portion 50*a* of the associated guide path, and then to a rearward end of the horizontal portion 48*b* of the adjacent lower one of the guide paths. The drive track 44 then continues forwardly along the horizontal portion 48*b* of the lower guide path, vertically along the vertical portion 50*b* of the lower guide path, and then back to the rearward end of the upper guide path horizontal portion 48*a*. In this manner, translation of the flexible drive 46 along the drive track 44 carries portions of the flexible drive simultaneously in the same horizontal direction along respective horizontal portions 48*a*, 48*b* of each guide track and in the same vertical direction along respective vertical portions 50*a*, 50*b* of each guide track.

In the illustrated embodiment, a plurality of rollers 52, such as for example wheels, sprockets, or the like, are provided at the various corners of the drive track 44 to support the flexible drive 46 along the drive track 44 and to facilitate smooth translation of the flexible drive 46 along the drive track 44. Additionally, a drive wheel 54 is provided along the drive track 44 near a rearward portion thereof. The drive wheel 54 is configured to engage the flexible drive 46 such that rotation of the drive wheel 54 results in linear translation of the flexible drive 46 along the drive track 44. In the illustrated embodiment, the drive wheel 54 is positioned at a rearward end of the horizontal portion 48*b* of the lower guide path. However, those skilled in the art will recognize other suitable locations for the drive wheel 54 which may be employed without departing from the spirit and scope of the present general inventive concept.

Figure 3:
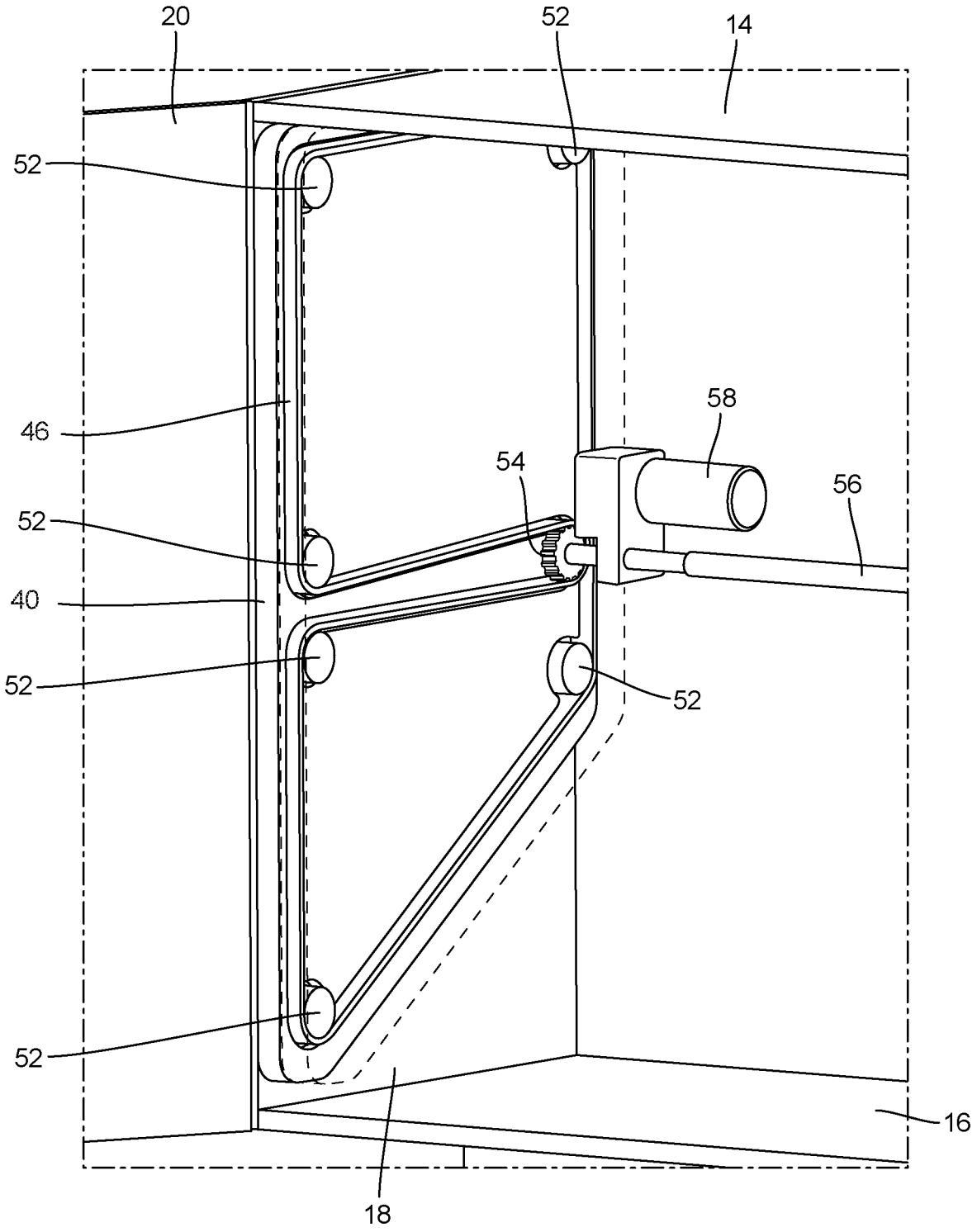
FIG. 3 illustrates a partial perspective view showing a close up of a portion of the powered lift system of FIG. 1.
Figure 4:
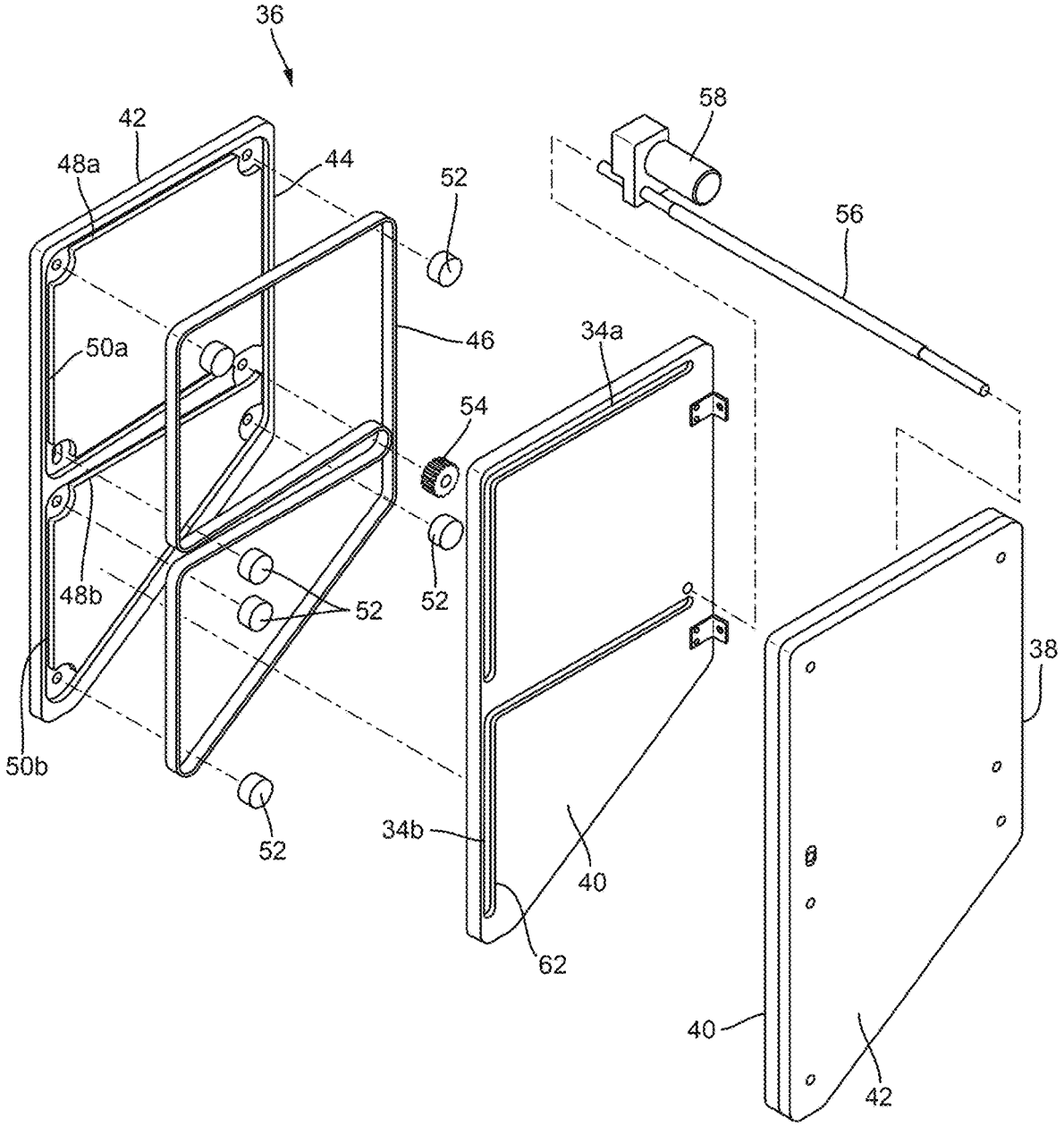
FIG. 4 is an exploded view showing portions of the powered lift system of FIG. 1.
Figure 5:
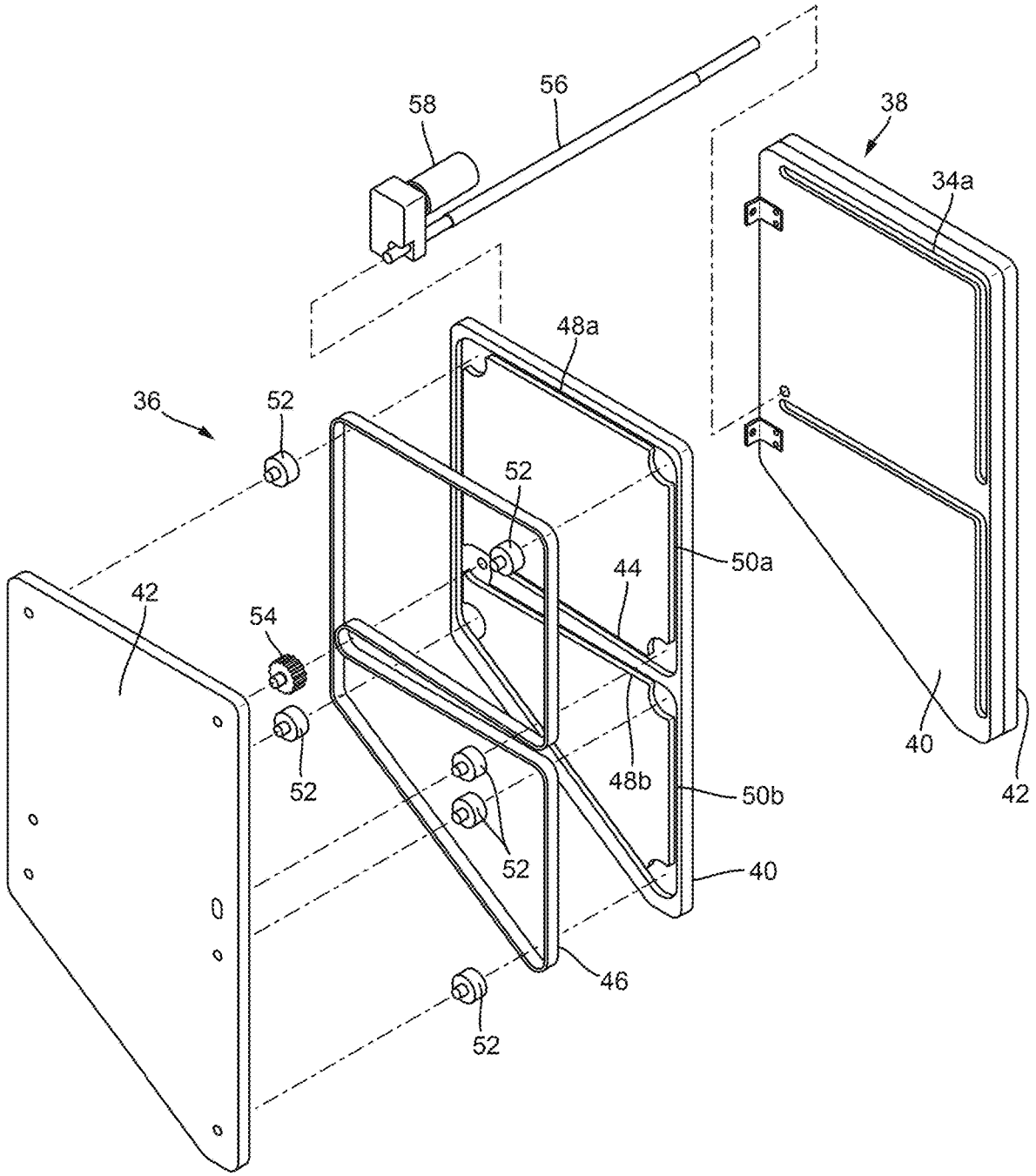
FIG. 5 is an exploded view showing a different perspective of the features of the powered lift system shown in FIG. 4.

In the illustrated embodiment, the respective drive wheels 54 of the opposite first and second drive panel units 36, 38 are arranged coaxially with one another and are connected to a drive axle 56, such that rotation of the drive axle 56 results in co-rotation of the drive wheels 54 of the two drive panel units 36, 38. This co-rotation of the drive wheels 54, in turn, results in simultaneous translation of the flexible drives 46 of the two drive panel units 36, 38 along their respective drive tracks 44. Referring to FIGS. 3 and 4, a motor 58 is provided in operable engagement with the drive axle 56 and is configured to rotate the drive axle 56 in opposite forward and rearward annular directions. Thus, the motor 58 is configured to transmit rotational power to drive the flexible drives 46 in opposite forward and backward directions along their respective drive tracks 44.

Figure 8:
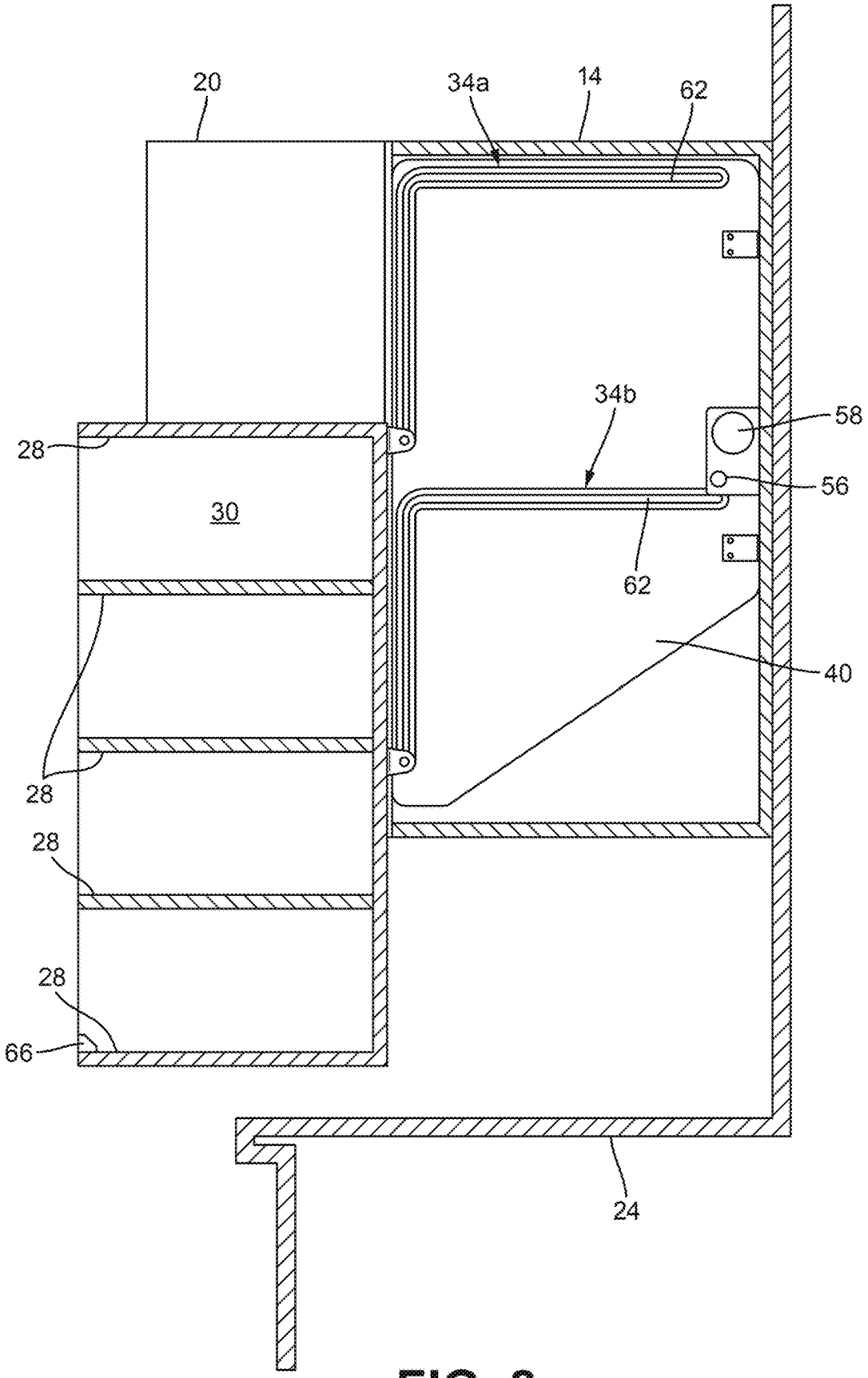
FIG. 8 is a cross-sectional side view of the powered lift system and cabinet shown in FIG. 7.
Figure 9:
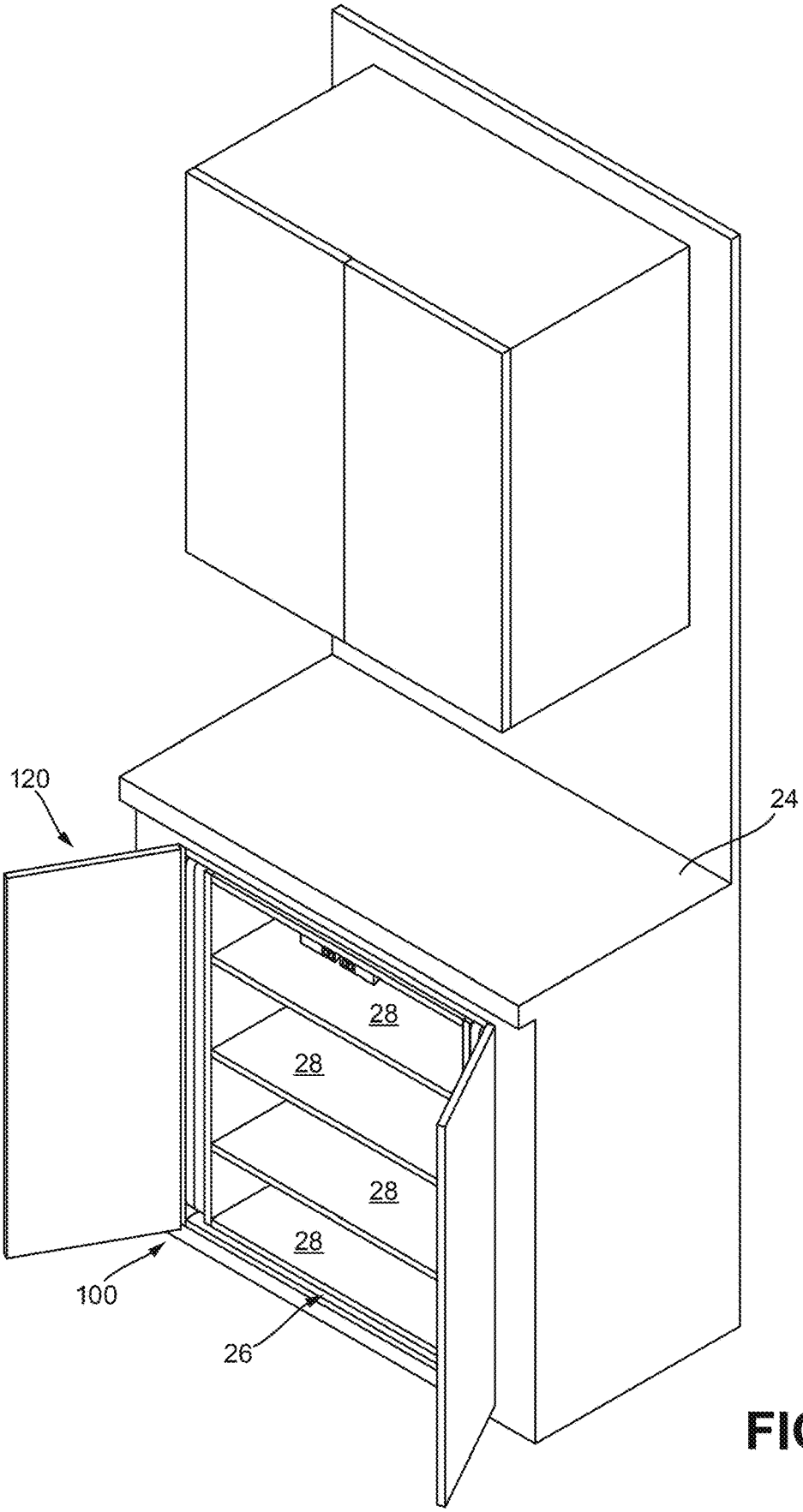
FIG. 9 is a perspective view of a powered lift system for cabinet shelves installed in a cabinet according to another example embodiment of the present general inventive concept.
Figure 10:
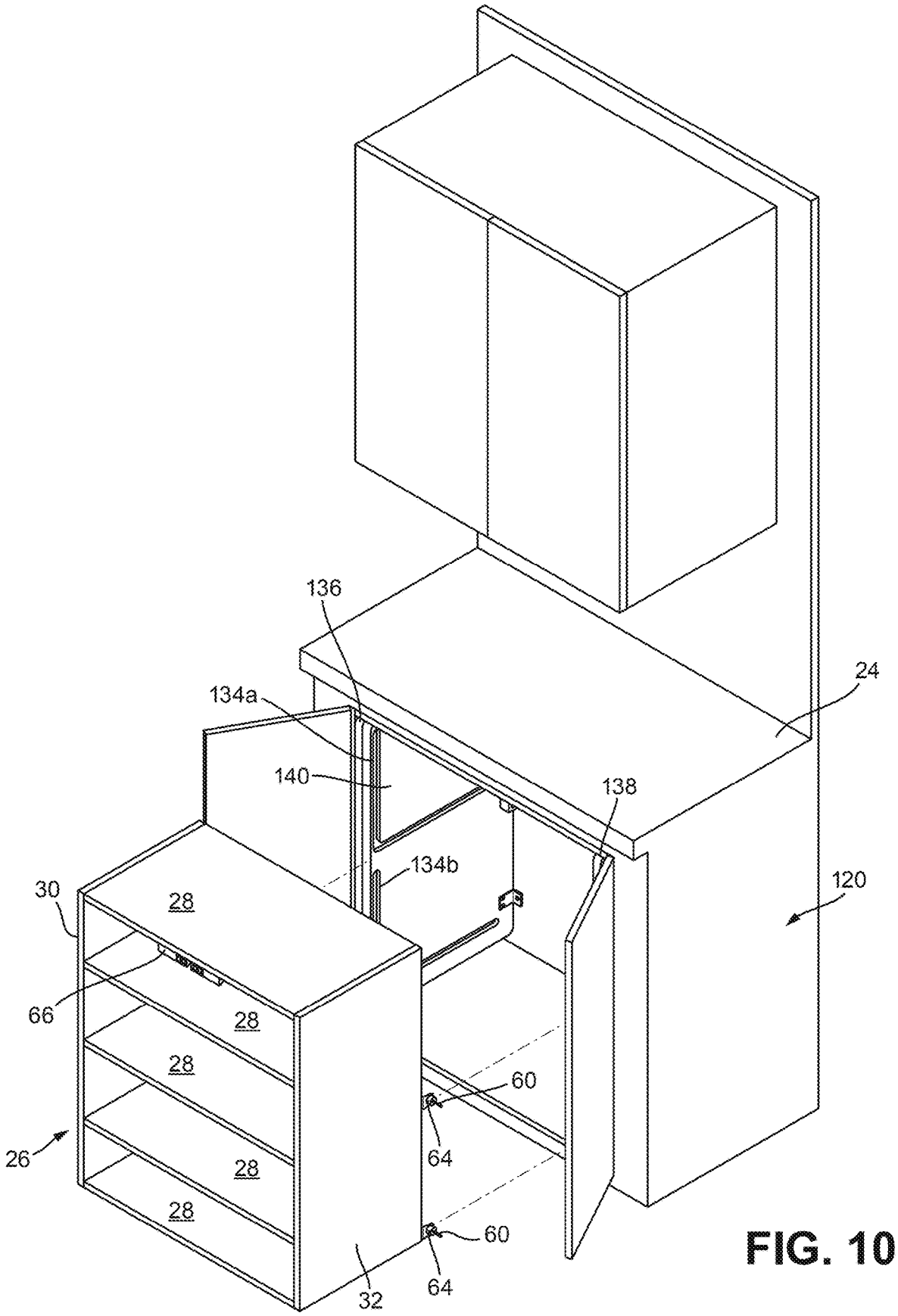
FIG. 10 illustrates a partially-exploded perspective view of the powered lift system and cabinet of FIG. 9.

FIG. 8 illustrates a cross-sectional view of the lift system 10 installed in the cabinet 12. In the illustrated embodiment, the above-discussed guide tracks 34*a*, 34*b* are defined along the inner drive panels 40 in the form of a pair of channels formed through each inner drive panel 40 and extending along each of the above-discussed guide paths of the respective drive panel unit. Each of the guide tracks 34*a*, 34*b* is shaped and oriented along the respective inner drive panel 40 to conform generally to a corresponding guide path of the drive track 44 within the corresponding drive panel unit 36, 38. In the illustrated embodiment, each guide track 34*a*, 34*b* opens to and along a corresponding one of the guide paths of the drive track 44, forming a through channel along the inner drive panel 40 that follows the respective guide path of the drive track 44. Thus, each of the guide tracks 34*a*, 34*b* provides access from within the cabinet 12 through the inner drive panel 40 to the portion of the flexible drive 46 extending along the portion of the drive track 44 defined by the associated guide path. Thus, similarly to the guide paths discussed above, each guide track 34*a*, 34*b* defines a substantially horizontal segment extending in a front-to-back orientation along the inner drive panel 40, and a substantially vertical segment extending from a forward end of an associated horizontal segment in a vertical direction.

With reference again to FIG. 2, a plurality of follower pins 60 are provided along rear edges of the first and second opposite side walls 30, 32 of the shelf unit 26. The follower pins 60 are arranged in a spaced apart configuration at corresponding locations along the rear edges of the side walls 30, 32 such that when the shelf unit 26 is received within the cabinet 12, the follower pins 60 extend from the rear edges of the side walls 30, 32 through the respective guide tracks 34*a*, 34*b* of the associated inner drive panels 40 and engage portions of the flexible drive 46 therethrough. The follower pins 60 are each pinned in relation to respective locations along the associated flexible drive 46. Thus, as the flexible drives 46 are driven by the motor 58 and associated linkages in the above-discussed forward and backward directions along the respective drive tracks 44, the follower pins 60 and shelf unit 26 are carried along the path defined by the associated guide tracks 34*a*, 34*b*.

In the illustrated embodiment, each of the guide tracks 34*a*, 34*b* defines a lip 62 extending about a perimeter thereof inward along the guide track 34*a*, 34*b*. A guide wheel 64 is provided surrounding each of the follower pins 60 and is sized to fit within the respective guide track 34*a*, 34*b* and to engage the lip 62 within the guide track 34*a*, 34*b* to limit movement of the associated follower pin 60 in relation to the guide track 34*a*, 34*b* in directions other than along the guide path. Thus, the guide wheels 64 assist in maintaining each of the follower pins 60 and associated shelf unit 26 in proper alignment between the drive panel units 36, 38 with the follower pins 60 in proper engagement within their respective guide tracks 34*a*, 34*b* and with their respective flexible drives 46.

As shown in FIG. 1, a user interface 66, which in this example embodiment is a plurality of buttons, is provided in operable engagement with the motor 58 to allow the user to selectively drive the flexible drives 46 along the respective drive tracks 44, thus driving the follower pins 60 and shelf unit 26 along the path defined by the various guide tracks 34*a*, 34*b*. In various embodiments, the user interface 66 may be provided to allow a user to advance the shelf unit 26 forward or backward along the guide paths, and in some embodiments individual buttons may be configured to control the system so as to bring the shelf unit 26 fully outward and offset from the cabinet 12 or to bring the shelf unit from a position outside, or partially outside, the cabinet 12 to fully within the cabinet 12. The user interface 66 may be provided at various locations in and around the cabinet 12 or shelf unit 26, for example in the illustrated embodiment, near the front edge of one of the shelves 28, to provide easy access to a user, as well as to prevent interference with any other components of the cabinet 12, shelf unit 26, or powered lift system 10. In various example embodiments, such as that illustrated in FIG. 1, the user interface 66 may include a housing that contains the various buttons in a neat and organized fashion and that is shaped to minimize interference with the use of the shelves 28 and cabinet 12.

The user interface or controls of various example embodiments may provide a directional switch or buttons, either along with or instead of the shelf dedicated buttons described herein, to cause movement of the shelf unit 26 until the user sees or is close to the shelf that the user desires to access. Various other example embodiments may provide a host of other different control configurations, such as a single rocker switch, a screen with a graphical user interface (GUI), voice activated controls, etc., and/or may communicate wirelessly with a smartphone or tablet to control the electrical actuator.

Various example embodiments of the present general inventive concept may provide various forms of smart controls for the powered lift system, which may provide secondary controls for other cabinetry features. Such an example embodiment may let the operator actuate the powered features provided to one or more individual cabinets via wireless connectivity through an application on an information processing device such as a smartphone, tablet, etc., and/or with a centralized touchscreen interface controlling all of the cabinets. In various example embodiments such power-able features may include actuation of doors and/or drawers, locking of doors and/or drawers, extending/retracting shelving, a powered appliance lift, controlling lighting in the cabinets, etc., or any combination of such features. Such smart control features may be optional in the various example embodiments of the present general inventive concept, and any and all such powered features may also be controlled by a hardwired dedicated interface accessible from, for example, the front side of each cabinet. In example embodiments in which only local (proximate) control of the cabinets may be desired, the cabinets may be connected together via short-range wireless technology such as BLUETOOTH®. Each cabinet may have an individual BLUETOOTH® module, and one of the cabinets (or a separate master device) may act as the BLUETOOTH® hub. This would enable controlling a certain function of several cabinets at the same time. Such a configuration would be useful, for example, for turning the lighting on/off on all cabinets simultaneously, etc. Remote (distant) control of the cabinets may be achieved by adding a master Wi-Fi module to a cabinet (or by adding a separate master device) that also acts as the BLUETOOTH® hub. This "master" device may receive input over the local Wi-Fi network and relay the output to the cabinets via BLUETOOTH® or an equivalent wireless method. The apps on smartphones/tablets may be, for example, Android/iOS apps, open-source home automation software such as Home Assistant, or the like. The latter may work with a dedicated PC, which could also be used as the Wi-Fi/BLUETOOTH® hub. In such example embodiments as these described above, the two-way data transfer may be established to allow remote monitoring of actuator or lock status, to see if, for example, assisted living residents are using the system.

Figure 6:
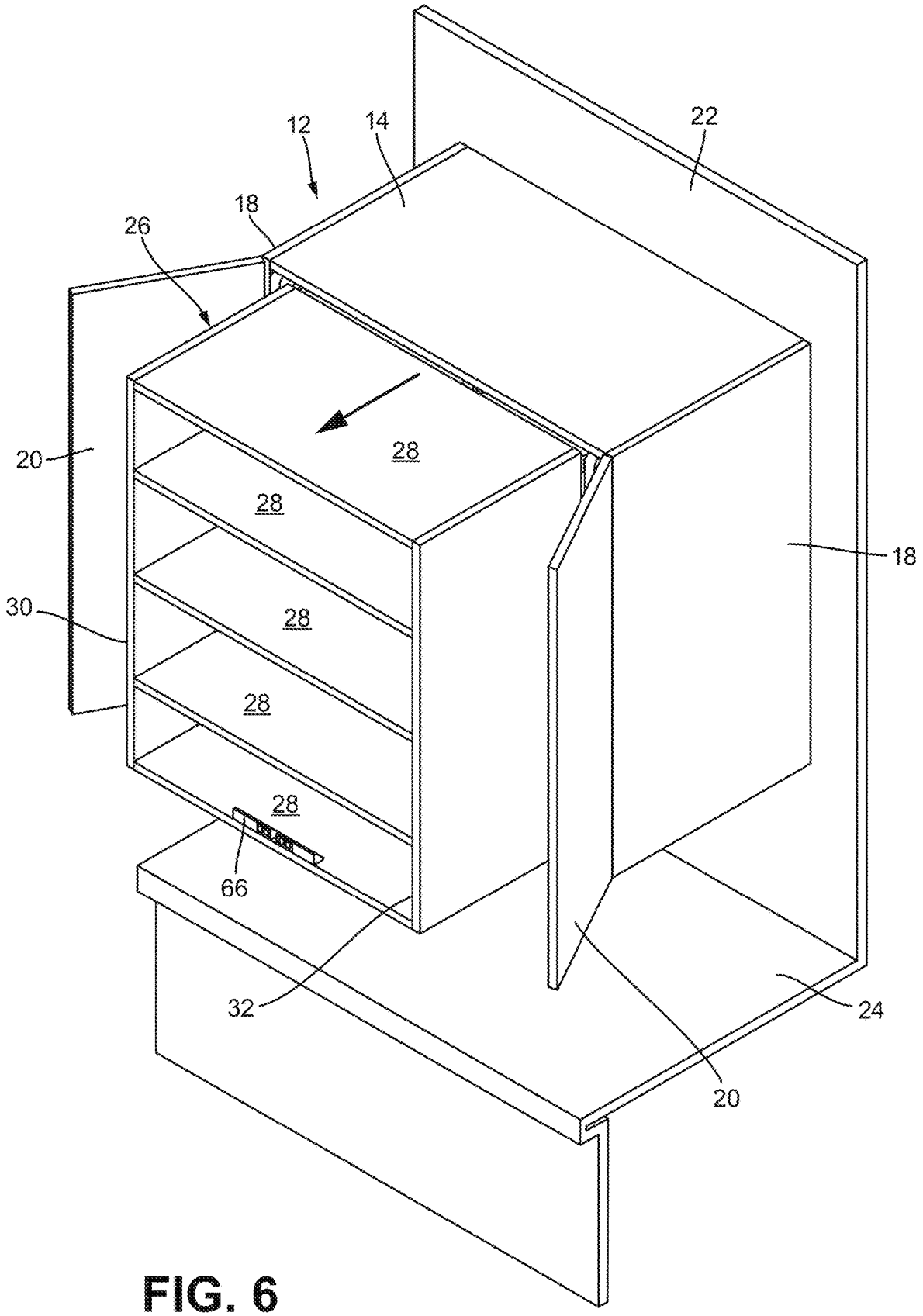
FIG. 6 is a perspective view of the powered lift system and cabinet of FIG. 1, showing a shelf unit translated outward from the cabinet.
Figure 7:
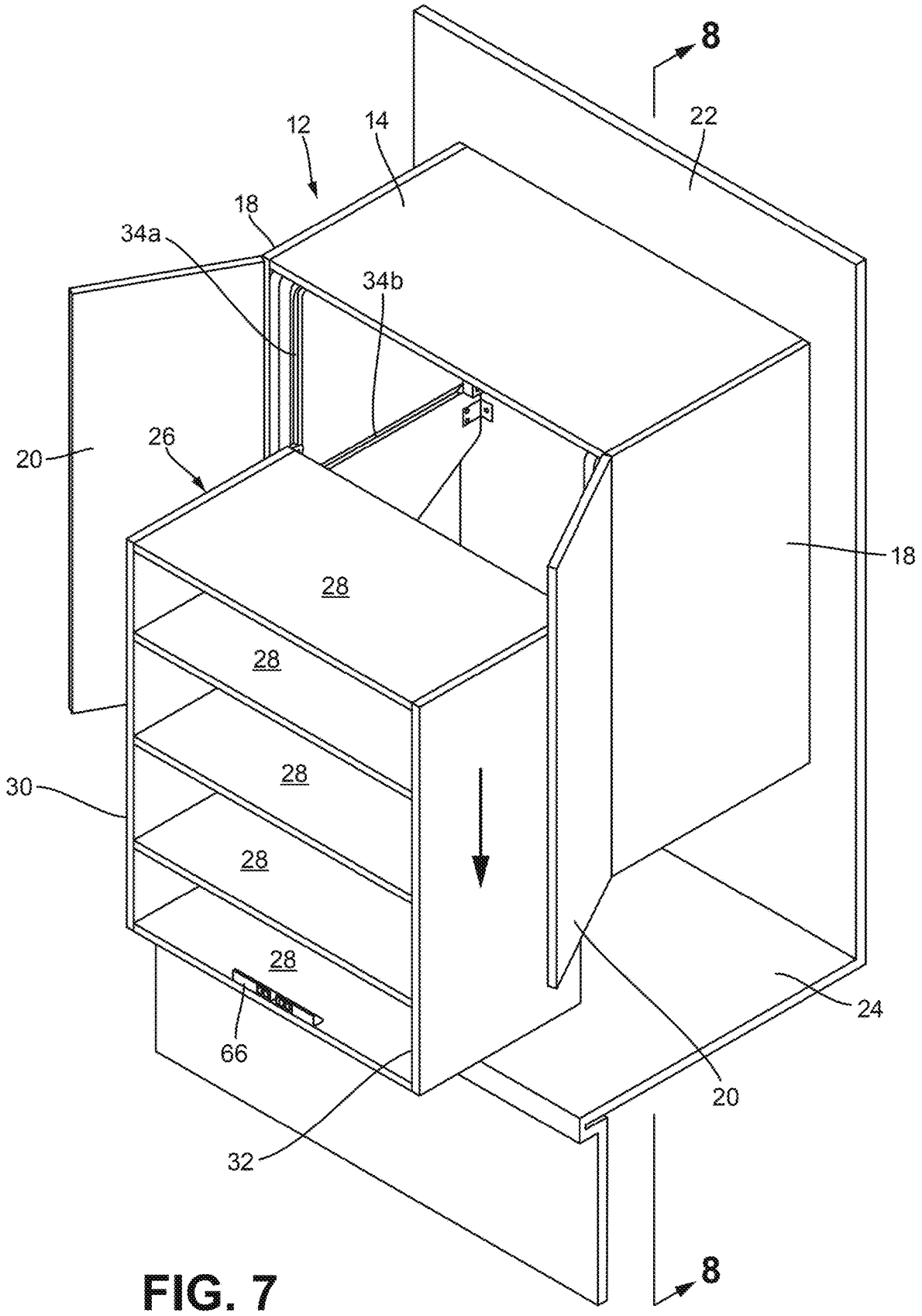
FIG. 7 is a perspective view of the powered lift system and cabinet of FIG. 1, showing the shelf unit translated downward from the cabinet.

FIGS. 1, 6, and 7 illustrate a movement operation of the follower pins 60 and shelf unit 26 along the path defined by the various guide tracks 34*a*, 34*b*. Upon actuation of the user interface 66, each of the flexible drives 46 may be driven along its respective drive track 44, such that the flexible drives 46 cooperate to carry the various follower pins 60 simultaneously along their respective guide tracks 34*a*, 34*b*. As illustrated in FIGS. 1, 6, and 7, each of the horizontal portions 48*a*, 48*b* of the guide paths extends sufficiently rearwardly and forwardly within the cabinet 12 that movement of the follower pins 60 along the horizontal portions of the guide tracks 34*a*, 34*b* from the rearward limits thereof to the forward limits thereof results in translation of the shelf unit 26 from a first position (see FIG. 1), in which the shelf unit 26 is fully received within the cabinet 12, to a second position (see FIG. 6), in which the shelf unit 26 is fully removed from the cabinet 12. The vertical portions 50*a*, 50*b* of the guide paths each extend along respective forward edges of the drive panel units 36, 38, slightly offset rearwardly therefrom. Thus, continued movement of the follower pins 60 along the vertical portions of the guide tracks 34*a*, 34*b* results in vertical translation of the shelf unit 26 in relation to the cabinet 12 from the above-discussed second position to a third position (see FIG. 7), in which the shelf unit 26 is offset vertically in relation to the cabinet 12. Likewise, in various embodiments the user interface 66 may be actuated to cause simultaneous movement of the follower pins 60 from the third position, along the vertical portions 50*a*, 50*b* of the guide paths to the second position, and thence along the horizontal portions 48*a*, 48*b* of the guide paths to the first position, whereupon the shelf unit 26 is returned to the interior of the cabinet 12.

In various embodiments, the above-discussed user interface 66 and motor 58 may be configured with "shut off" features or other control limits which prevent the motor 58 from providing driving power to the flexible drives 46 to drive the follower pins 60 beyond the limits of the guide tracks 34*a*, 34*b* and associated guide paths. In other embodiments, the limits of the guide tracks 34*a*, 34*b* themselves may serve as "stops" which limit further movement of the follower pins 60 beyond the limits of the guide tracks 34*a*, 34*b* and associated guide paths. Those skilled in the art will recognize other devices and configurations which may be employed to accomplish the above-discussed limiting of the follower pins 60 to movement within the guide tracks 34*a*, 34*b*, and such other devices and configurations may be used without departing from the spirit and scope of the present general inventive concept.

It will be recognized that, in order to facilitate proper movement of the shelf unit 26 throughout the first, second and third positions described above, each of the follower pins 60 is mounted along a respective rear edge of the first and second opposite side walls 30, 32 of the shelf unit 26 in a manner which positions the follower pin 60 in a location rearwardly offset from the back of the shelf unit 26. This "offset" between the follower pins 60 and the rear of the shelf unit 26 is greater than the horizontal offset between the vertical portions 44*a*, 44*b* of the guide paths and a forward edge of the cabinet 12. Thus, when the shelf unit 26 is moved from the above-discussed first position (FIG. 1) to the second position (FIG. 6), the shelf unit 26 is translated fully from within the cabinet 12. Thus, movement of the follower pins 60 along the vertical portions of the guide tracks 34*a*, 34*b* allows vertical translation of the shelf unit 26 in relation to the cabinet 12 unimpeded by the top and bottom panels 14, 16 of the cabinet 12.

It will be recognized that, in various embodiments, each of the guide tracks 34*a*, 34*b* and associated guide paths of each drive track 44 is sized, positioned, and oriented along respective drive panel units 36, 38, and in relation to one another, such that the shelf unit 26 is maintained in a substantially upright, level, and forward-facing orientation throughout translation of the shelf unit 26 between the above-discussed first, second, and third positions. For example, in various embodiments, at least the guide tracks 34*a*, 34*b* and associated guide paths of a first of the drive panel units 36 are shaped to resemble a mirror-image of the guide tracks 34*a*, 34*b* and associated guide paths of the opposite second drive panels unit 38. Thus, each follower pin 60 follows a similarly sized and shaped path, oriented in a similar direction, as each of the other follower pins 60, thus serving to maintain the shelf unit 26 in a substantially upright, level, and forward-facing orientation throughout translation of the shelf unit 26 along the path defined by the associated guide tracks 34*a*, 34*b*. In the illustrated embodiment, the entire drive track 44 and associated flexible drive 46 of each drive panel unit 36, 38 is shaped to resemble a mirror-image of the drive track 44 and associated flexible drive 46 of the other drive panels unit 36, 38. However, it will be recognized that a complete mirror-image resemblance of the drive tracks 44 and associated flexible drives 46 of the drive panel units 36, 38 is not critical to achieving the various features and aspects of the present general inventive concept. For example, in various embodiments, portions of the drive tracks 44 and flexible drives 46 not forming the above-discussed guide paths may be shaped differently from one another while still maintaining symmetry of the guide tracks 34*a*, 34*b* and associated guide paths, such that the shelf unit 26 is still maintained in a substantially upright, level, and forward-facing orientation throughout translation of the shelf unit 26 between the above-discussed first, second, and third positions. Those skilled in the art will recognize other variations which may be utilized without departing from the spirit and scope of the present general inventive concept.

In the embodiment shown in FIGS. 1-8, each of the guide tracks 34*a*, 34*b* and corresponding guide paths defined by the drive tracks 44 is shaped to direct the shelf unit 26 outward from the cabinet 12 and downward in relation to the cabinet 12. More specifically, in the illustrated embodiment, each of the vertical portions 50*a*, 50*b* of each guide path extends vertically downward from the forward end of an associated horizontal portion 48*a*, 48*b*. Thus, once the shelf unit 26 is brought forward along the various horizontal portions 48*a*, 48*b* and out from the cabinet 12 from the first position to the second position, continued movement of the shelf unit 26 toward the third position results in lowering of the shelf unit 26 in relation to the cabinet 12. As shown in the illustrated embodiment, such lowering of the shelf unit 26 in relation to the cabinet 12 could, for example, be used to lower the shelf unit 26 onto or toward a countertop 24 or other support surface or working surface positioned below the cabinet 12. However, it will be recognized that the powered lift system 10 may be configured to direct the shelf unit 26 in other directions in relation to the cabinet 12 once the shelf unit 26 exits the cabinet 12 without departing from the spirit and scope of the present general inventive concept.

For example, FIGS. 9-13 illustrate another embodiment of a powered lift system 100 constructed in accordance with various features and aspects of the present general inventive concept. In this embodiment, the powered lift system 100 is shown installed in a cabinet 120 that is installed beneath a countertop 24. In the embodiment of FIGS. 9-13, opposite first and second drive panel units 136, 138 are provided in which the drive track 144 defined between the respective inner drive panel 140 and outer drive panel 142 of each drive panel unit, as well as the corresponding guide tracks 134*a*, 134*b*, are configured to direct the shelf unit 26 outward from within the cabinet 120 and upward in relation to the cabinet 120. More specifically, in this embodiment, each of the vertical portions 150*a*, 150*b* of each guide path extends vertically upward from the forward end of an associated horizontal portion 148*a*, 148*b*. Thus, once the shelf unit 26 is brought forward along the various horizontal portions 148*a*, 148*b* and out from the cabinet 120 from the first position to the second position, continued movement of the shelf unit 26 toward the third position results in raising of the shelf unit 26 in relation to the cabinet 120. As shown in the illustrated embodiment, such lifting of the shelf unit 26 in relation to the cabinet 120 could, for example, be used to raise the shelf unit 26 upward from a support surface, such as the floor, to a height which is more easily accessible by a user.

Figure 11:
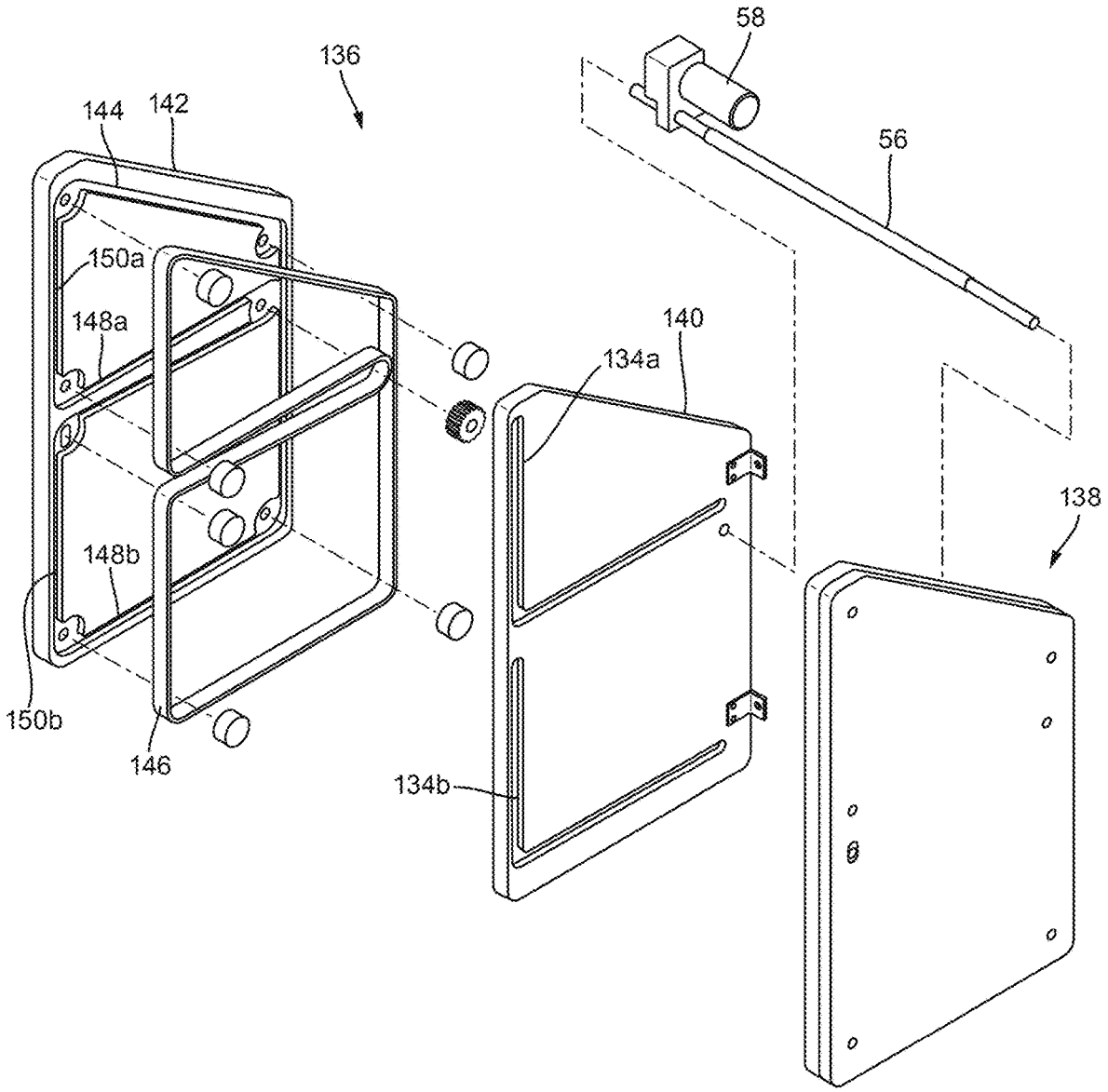
FIG. 11 is an exploded view showing portions of the powered lift system of FIG. 9.
Figure 12:
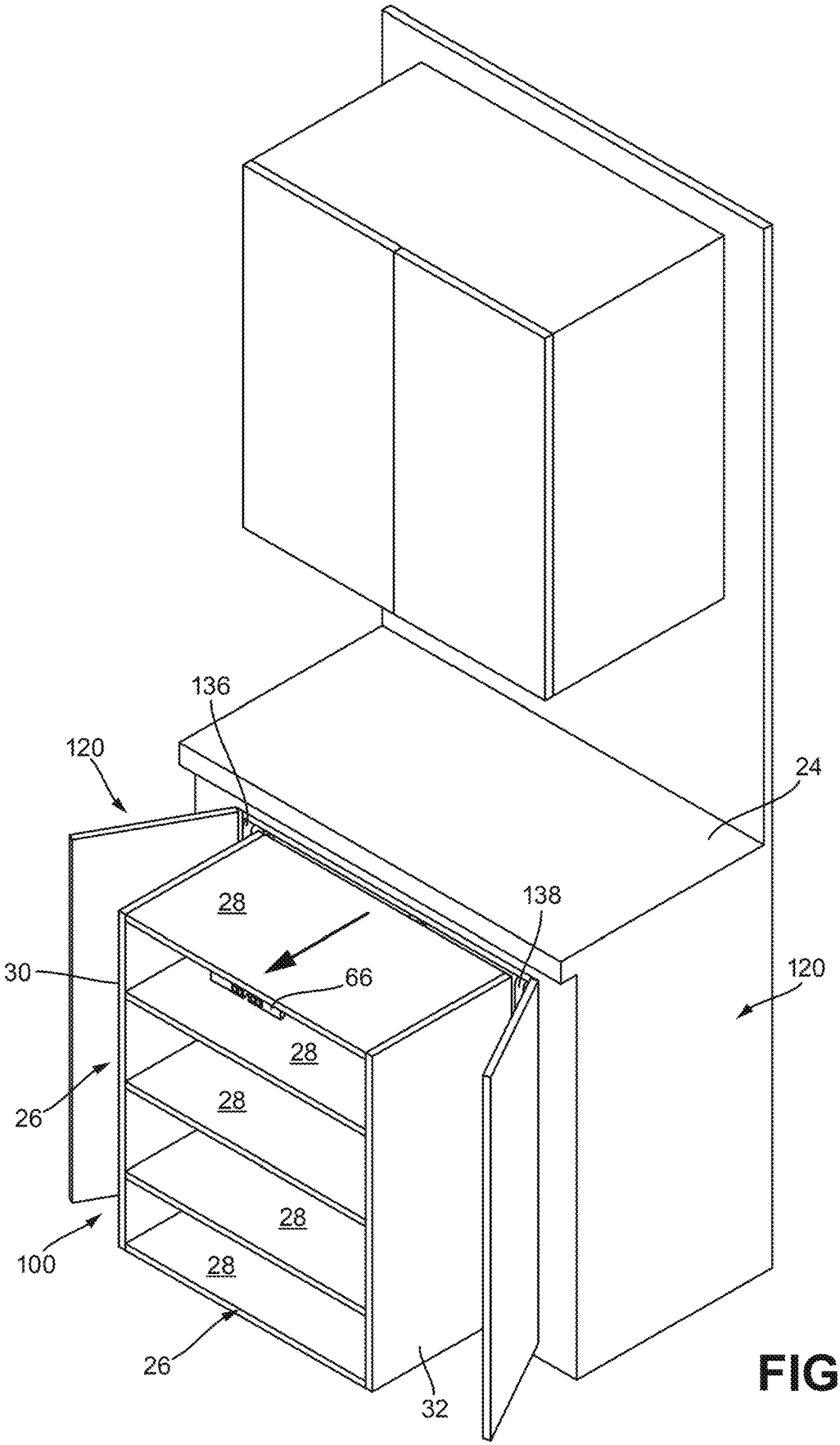
FIG. 12 is a perspective view of the powered lift system and cabinet of FIG. 9, showing a shelf unit translated outward from the cabinet.
Figure 13:
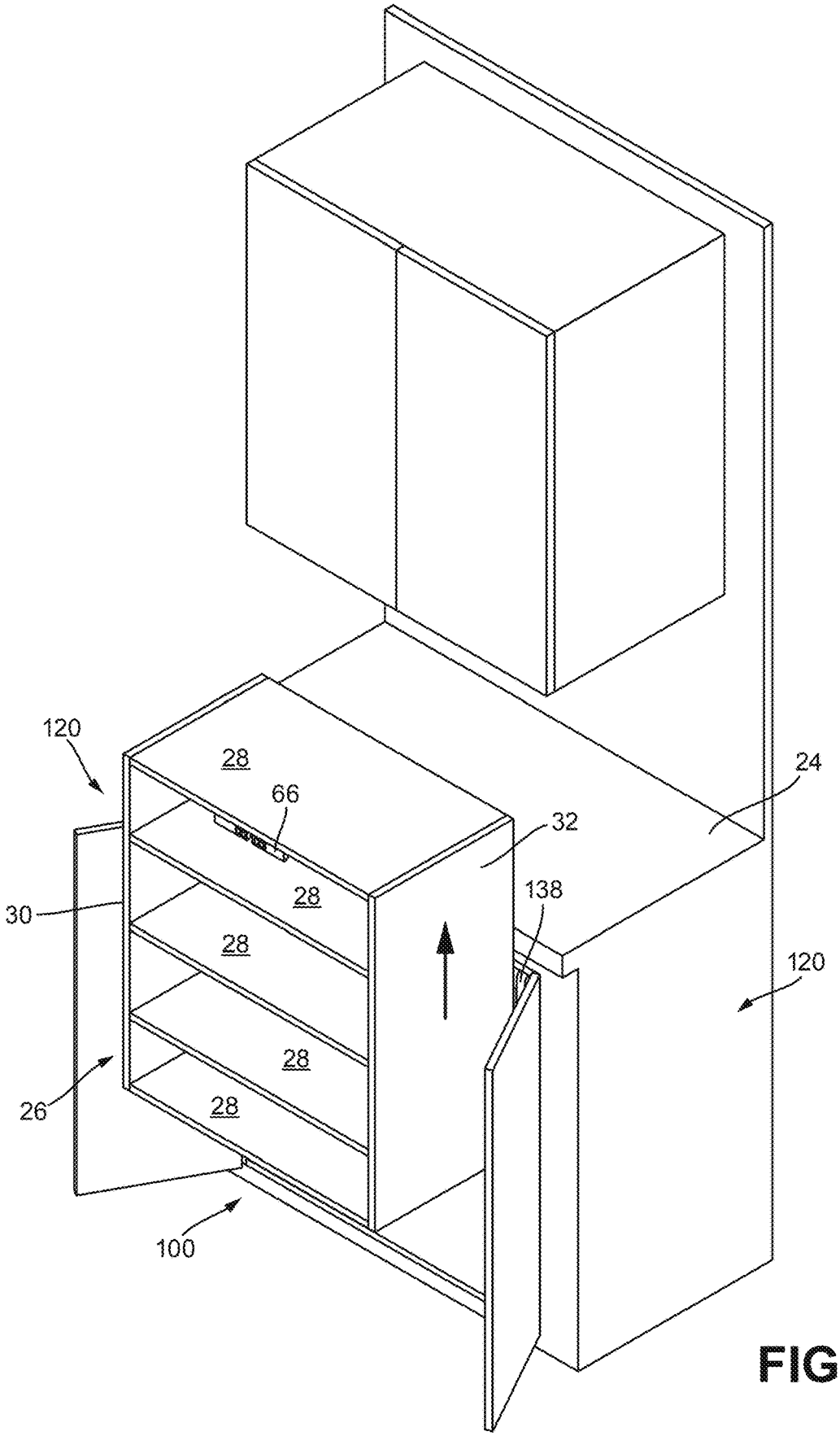
FIG. 13 is a perspective view of the powered lift system and cabinet of FIG. 9, showing the shelf unit translated upward from the cabinet.

As shown in FIG. 11, in this embodiment, similar to the above, a circuitous drive track 144 is formed between inner and outer drive panels 140, 142 of each drive panel unit 136, 138, and the drive track 144 is configured to receive and carry a circuitous flexible drive 146 along the length of the drive track 144. Also, similar to the above, the drive track 144 includes at least one, and preferably two or more, horizontal portions 148*a*, 148*b* extending in a front-to-back orientation along the inner and outer drive panels 140, 142. However, in this embodiment the vertical portions 150*a*, 150*b* associated with each horizontal portion 148*a*, 148*b* extend from a forward end of an associated horizontal portion 148*a*, 148*b* in an upward direction. Thus, in the illustrated embodiment, the overall path of the drive track 144 extends forwardly along the horizontal portion 148*a* of an upper one of the guide paths, thereafter vertically upward along the vertical portion 150*a* of the associated guide path, and then to a rearward end of the horizontal portion 148*b* of the adjacent lower one of the guide paths. The drive track 144 then continues forwardly along the horizontal portion 148*b* of the lower guide path, vertically upward along the vertical portion 150*b* of the lower guide path, and then back to the rearward end of the upper guide path horizontal portion 148*a*. In this manner, translation of the flexible drive 146 along the drive track 144 once again carries portions of the flexible drive simultaneously in the same horizontal direction along respective horizontal portions 148*a*, 148*b* of each guide track and in the same upward direction along respective vertical portions 150*a*, 150*b* of each guide track.

It will be understood that other orientations may be utilized without departing from the spirit and scope of the present general inventive concept. For example, depending on the orientation of the above-discussed vertical portions 150*a*, 150*b* of each guide path in relation to the horizontal portions 148*a*, 148*b* other embodiments may be achieved in which the lift system is configured to allow the shelf unit 26 to move along the guide tracks 134*a*, 134*b* horizontally outward from within the cabinet 120 and at any of a variety of angles. In this manner, the vertical portions 150*a*, 150*b* and horizontal portions 148*a*, 148*b* of each guide path, and the associated guide tracks 134*a*, 134*b*, may cooperate to define any of a number of predetermined paths for movement of the shelf unit 26 using the powered lift system concept described herein.

From the foregoing description, it will be recognized that a powered lift system has been disclosed that allows a user to translate a shelf, or set of shelves, from within a cabinet to a forward position outside the cabinet and to an altered elevation in relation to the cabinet in order to allow more convenient access to the shelf or shelves. Various example embodiments of the present general inventive concept may provide convenient reach access and improved usability to a cabinet space for private residential or assisted living facilities by allowing powered shelf movements to be incorporated into custom cabinets. In various example embodiments the shelves may be enclosed to assure that a shelf's contents do not interfere with other items or surfaces in the cabinet during motion. A control panel or other such user controls may allow the movement of a shelf or set of shelves along a path as needed, such that the shelves may be stopped in a position that is most accessible by the user.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. A cabinet having a lift system comprising:

at least one guide path extending along at least one side wall of the cabinet, the at least one guide path defining a horizontal segment and a non-horizontal segment, wherein the at least one guide path is defined by a drive track extending along the at least one side wall of the cabinet, and wherein the drive track defines a first guide path and a second guide path, each guide path defining a horizontal segment and a non-horizontal segment;

a drive mechanism comprising a drive member disposed along the at least one guide path and an assembly configured to drive the drive member along the at least one guide path; and a shelf unit in engagement with the drive member;

whereby translation of the shelf unit along the horizontal segment of the at least one guide path moves the shelf unit between a first position inside the cabinet and a second position outside the cabinet, and whereby translation of the shelf unit along the non-horizontal segment of the at least one guide path moves the shelf unit in a nonhorizontal direction outside the cabinet, and;

wherein the drive track is a circuitous track.

2. The cabinet of claim 1, wherein the drive member comprises a flexible drive extending along the drive track.

3. The cabinet of claim 2, wherein the drive track extends from a forward end of the horizontal segment of the first guide path, along a vertical segment of the first guide path, to a rearward end of the horizontal segment of the second guide path, along a vertical segment of the second guide path, and to a rearward end of the horizontal segment of the first guide path.

4. The cabinet of claim 3 further comprising a plurality of followers, each follower secured to the shelf unit and fixed along a portion of the flexible drive along a corresponding guide path, wherein movement of the flexible drive along the drive track translates each follower along the corresponding guide path.

5. The cabinet of claim 4, the horizontal segment of each guide path being of equal length and oriented in parallel, spaced apart relationship to the horizontal segment of each other guide path.

6. The cabinet of claim 5, each follower being mounted in a respective position offset from a rear of the shelf unit.

7. The cabinet of claim 6, the drive track being defined by a drive panel removably secured along the at least one side wall of the cabinet.

8. A cabinet having a lift system comprising:

at least one guide path extending along at least one side wall of the cabinet, the at least one guide path defining a horizontal segment and a non-horizontal segment;

a drive mechanism comprising a drive member disposed along the at least one guide path and an assembly configured to drive the drive member along the at least one guide path; and a shelf unit in engagement with the drive member;

whereby translation of the shelf unit along the horizontal segment of the at least one guide path moves the shelf unit between a first position inside the cabinet and a second position outside the cabinet, and whereby translation of the shelf unit along the non-horizontal segment of the at least one guide path moves the shelf unit in a nonhorizontal direction outside the cabinet, and;

wherein the drive track extends from a forward end of the horizontal segment of the first guide path, along a vertical segment of the first guide path, to a rearward end of the horizontal segment of the second guide path, along a vertical segment of the second guide path, and to a rearward end of the horizontal segment of the first guide path.

9. The lift system of claim 8, the horizontal segment of each guide path being of equal length and oriented in parallel, spaced apart relationship to the horizontal segment of each other guide path.

10. The lift system of claim 9 further comprising a first drive panel securable along a first inner side surface of the cabinet and a second drive panel securable along a second inner side surface of the cabinet, each of the first and second drive panels defining a drive track, the drive track of the first drive panel being formed to mirror the drive track of the second drive panel, and wherein the drive member further comprises a first drive member received along the drive track of the first drive panel and a second drive member received along the drive track of the second drive panel, the shelf unit being in engagement with the first and second drive members.

11. The lift system of claim 10, wherein the assembly of the drive mechanism is configured to drive the first and second drive members in unison with one another.

* * * * *